US005647558A

United States Patent [19]

Linick

[11] Patent Number: 5,647,558

[45] Date of Patent: Jul. 15, 1997

[54] METHOD AND APPARATUS FOR RADIAL THRUST TRAJECTORY CORRECTION OF A BALLISTIC PROJECTILE

[75] Inventor: James Linick, Naples, Fla.

[73] Assignee: Bofors AB, Karlskoga, Sweden

[21] Appl. No.: 431,761

[22] Filed: May 1, 1995

Related U.S. Application Data

[63] Continuation-in-part of Ser. No. 388,039, Feb. 14, 1995, abandoned.

[51] Int. Cl.[6] ..... F41G 7/00

[52] U.S. Cl. ..... 244/3.11; 244/3.2; 244/3.21

[58] Field of Search ..... 244/3.11, 3.12, 244/3.13, 3.14, 3.15, 3.16, 3.19, 3.2, 3.21, 3.22; 89/41.07

[56] References Cited

U.S. PATENT DOCUMENTS

| | | | |
|---|---|---|---|
| 3,362,658 | 1/1968 | Ito et al. | 244/3.2 |
| 3,698,811 | 10/1972 | Weil | 244/3.14 |
| 3,758,052 | 9/1973 | McAlexander et al. | 244/3.14 |
| 3,832,711 | 8/1974 | Grant et al. | 244/3.14 |
| 3,856,237 | 12/1974 | Torian et al. | 244/3.11 |
| 3,860,199 | 1/1975 | Dunne | 244/3.13 |
| 3,868,883 | 3/1975 | Tucker | 244/3.12 |
| 3,995,792 | 12/1976 | Otto et al. | 244/3.14 |
| 4,010,467 | 3/1977 | Slivka | 244/3.16 |
| 4,097,007 | 6/1978 | Fagan et al. | 244/3.11 |
| 4,100,545 | 7/1978 | Tabourier | 342/62 |
| 4,120,587 | 10/1978 | Vali et al. | 356/106 LR |
| 4,176,814 | 12/1979 | Albrektsson et al. | 244/3.15 |
| 4,179,088 | 12/1979 | French | 244/3.19 |
| 4,219,170 | 8/1980 | Esker | 244/3.14 |
| 4,220,296 | 9/1980 | Hesse | 244/3.14 |
| 4,350,983 | 9/1982 | Blaha et al. | 244/3.19 |
| 4,407,464 | 10/1983 | Linick | 244/3.13 |
| 4,453,087 | 6/1984 | Linick | 250/334 |
| 4,470,562 | 9/1984 | Hall et al. | 244/3.2 |
| 4,556,656 | 12/1985 | Maudal et al. | 244/3.11 |
| 4,614,317 | 9/1986 | Stavis | 244/3.19 |
| 4,641,801 | 2/1987 | Lynch, Jr. et al. | 244/3.11 |
| 4,655,411 | 4/1987 | Franzén et al. | 244/3.11 |
| 4,674,408 | 6/1987 | Stessen | 244/3.22 |
| 4,679,748 | 7/1987 | Blomqvist et al. | 244/3.19 |
| 4,711,152 | 12/1987 | Fortunko | 89/6.5 |
| 4,741,245 | 5/1988 | Malone | 89/41.03 |
| 4,763,857 | 8/1988 | Booth et al. | 244/3.22 |
| 4,883,239 | 11/1989 | Lachmann et al. | 244/3.15 |
| 4,886,330 | 12/1989 | Linick | 350/6.5 |
| 4,898,340 | 2/1990 | Kliger et al. | 244/3.11 |
| 4,899,956 | 2/1990 | King et al. | 244/3.22 |
| 4,901,946 | 2/1990 | Arnaud et al. | 244/3.13 |
| 4,913,548 | 4/1990 | Vick | 356/350 |
| 4,925,129 | 5/1990 | Salkeld et al. | 244/3.11 |
| 4,926,183 | 5/1990 | Fourdan | 342/67 |
| 4,951,901 | 8/1990 | Dunne | 244/3.11 |
| 4,971,266 | 11/1990 | Mehltretter et al. | 244/3.19 |
| 4,997,144 | 3/1991 | Wolff et al. | 244/3.14 |
| 5,054,712 | 10/1991 | Bar et al. | 244/3.22 |

(List continued on next page.)

OTHER PUBLICATIONS

Foss, C.F. and Miller, D., Modern Land Combat, pp. 39–45.

*Primary Examiner*—Charles T. Jordan
*Assistant Examiner*—Theresa M. Wesson
*Attorney, Agent, or Firm*—Howrey & Simon; Thomas J. Scott, Jr.

[57] ABSTRACT

A system for controlling the placement of a gun launched projectile adapted with a radial impulse motor incorporated into the projectile for imparting a thrust subsequent to launching and a receiver incorporated into the projectile for targeting information for determining the projectile trajectory and the projectile roll rate, roll position, and pitch, i.e., vertical reference; and a computer linked to the receiver and the radial impulse motor for determining the projectile trajectory and the projectile roll rate, roll position, and vertical reference time after launch of the projectile and angle of corrective vector to ignite the radial impulse motor to affect the trajectory of the projectile to land the projectile on a desired target.

23 Claims, 5 Drawing Sheets

U.S. PATENT DOCUMENTS

| | | | |
|---|---|---|---|
| 5,118,050 | 6/1992 | Arnold et al. | 244/3.14 |
| 5,131,602 | 7/1992 | Linick | 244/3.14 |
| 5,260,709 | 11/1993 | Nowakowski | 244/3.2 |
| 5,267,502 | 12/1993 | Gent et al. | 89/41.03 |
| 5,344,105 | 9/1994 | Youhanafe | 244/3.14 |
| 5,379,968 | 1/1995 | Grosso | 244/3.21 |
| 5,425,514 | 6/1995 | Grosso | 244/3.22 |
| 5,451,014 | 9/1995 | Dare et al. | 244/3.15 |

METHOD AND APPARATUS FOR RADIAL THRUST TRAJECTORY CORRECTION OF A BALLISTIC PROJECTILE

CROSS REFERENCE TO RELATED APPLICATIONS

This application is a continuation-in-part of a patent application Ser. No. 08/388,039 filed Feb. 14, 1995, now abandoned.

FIELD OF THE INVENTION

This invention relates to cannon-launched projectile or similar airborne vehicles. More particularly, this invention relates to apparatus and methods for searching for, tracking and remotely guiding cannon-launched projectile, rockets and similar airborne vehicles to impact a selected target.

DESCRIPTION OF THE PRIOR ART

It is well-recognized in the prior art that a cannon-launched projectile follows a ballistic trajectory which can be fairly well calculated. This knowledge enables a gunner to fire projectiles to impact pre-selected target areas with reasonable consistency and a first shot accuracy of approximately 1% to 5% of the range to the target.

It is also known to the prior art that a land based apparatus can search the space in which the cannon-launched projectiles or rockets are expected to appear (known as object space) and thereafter locate and track such projectiles while they are in flight. The purpose of such prior art systems is to aid artillery and rocket latch batteries obtaining greater accuracy by noting deviations from the expected trajectories of tracked projectiles, resulting from wind, weather or other reasons, i.e., internal and external ballistics. The artillery or launch battery, when given the flight details of an actual projectile trajectory, can then adjust its aim in subsequent salvos.

Such prior art systems utilized active radar, usually in the frequency range of 12.5 to 18 Gigahertzs to search object space. The reflected signal from the in-flight projectile is detected by the radar's receiving antenna. Then, a polar coordinate procedure can be used to track the in-flight projectile's path.

In these prior art systems, in order to maintain a radar lock on a projectile, the radar often, but not always, had to continuously emit a signal commonly referred to as a beam. The track data, once acquired, was fed into the radar computer for further processing and relay to a user, such as the battery command center, to indicate the trajectory of a projectile.

There also exists improved imaging methods for a remote tracking system. These systems involve fast framing thermal and active laser imaging systems comprising mechanical scanning devices for converting radiation in the far infrared spectral region to visible radiation in real time and at an information rate comparable to that of standard television. Such systems are commonly referred to as FLIR systems, the acronym for Forward Looking Infrared, and enable trackers in the field to effectively track projectiles when visually obscured by dust, darkness or other environmental conditions. These systems are disclosed in U.S. Pat. Nos. 4,407,464; 4,453,087; and 4,886,330, all issued to the present applicant, James Linick.

Another projectile targeting method, disclosed in U.S. Pat. No. 4,679,748 issued to Blomquist and the present applicant James Linick, discloses a cannon-launched projectile scanning and guidance system completely self-contained within the projectile itself. This system suffers from the inability of trackers at the artillery or launch battery to initiate control over the trajectory of the shell once flight has commenced and only have validity and value during the terminal homing stage of the trajectory; usually such a stage begins at an altitude of from 5000 to 2500 meters depending on weather and other factors.

It is also known to the art that a projectile can use a booster rocket along the longitudinal axis of the projectile to change the distance traveled by the projectile. Such a system, as disclosed in U.S. Pat. No. 3,758,052 to McAlexander and Stout, uses a ground radar to track the actual projectile trajectory, a ground based computer to compare the actual trajectory to a desired trajectory and a transmitter to transmit a signal to the projectile to ignite a longitudinal booster rocket to change the distance the projectile will travel. This system cannot impart a lateral course correction to a projectile, nor can it cause a projectile to travel less distance.

Therefore, it is an object of this invention to provide an apparatus and method which overcomes the aforementioned inadequacies of the prior art devices and provides an improvement which is a significant contribution to the launched projectile art.

Another object of the present invention is to provide an apparatus and method to impart a radial thrust of a predetermined magnitude to a projectile while in flight to cause the projectile to land on a desired target by transmitting targeting information to the in flight projectile using a computer and information about the projectile's trajectory to determine the precise time at which to apply the radial correcting thrust.

It is another object of the invention that the means for determining the projectile trajectory is a fiber optic laser gyroscope based inertial navigation system wholly contained within the projectile.

It is another object of the invention that the means for determining the projectile trajectory is with a ground based radar fire control system.

It is another object of the invention to utilize information from a means for determining partial projectile trajectory, i.e., internal ballistics, with a muzzle velocity detector that measures the velocity of the projectile as it leaves the gun barrel.

It is another object of the invention that the means for determining the projectile trajectory is with a global positioning system satellite receiver and antenna located in the projectile.

It is another object of the invention to update the desired target location while the projectile is in flight by using a datalink to relay the desired target's updated position from a ground system to the projectile thus addressing target location error (TLE).

The foregoing has outlined some of the more pertinent objects of the invention. These objects should be construed to be merely illustrative of some of the more prominent features and applications of the present invention. Many other beneficial results can be attained by applying the disclosed invention in a different manner or modifying the invention within the scope of the disclosure. Accordingly, other objects and a fuller understanding of the invention may be had by referring to the summary of the invention and detailed description describing the preferred embodiment of the invention, the drawings and the claims.

SUMMARY OF THE INVENTION

The present invention is an in-flight course correctable projectile, bomb, or rocket that functions in either a remote controlled semi-autonomous mode or fully-autonomous "fire and forget" mode. The course correctable projectile uses an impulse motor acting normal to the projectile trajectory at or near the projectile's center of mass to impart a course correcting thrust to the projectile. This course correcting force acts parallel to the projectile's radial axis to provide a fixed magnitude thrust vector in the plane normal to the projectile trajectory and at a precise radial angle. The present invention provides a means for igniting the impulse motor at the precise time and angle to affect a projectile course correction and thereby land the projectile on a desired target.

The present invention may calculate when to ignite the impulse motor in a semi-autonomous or fully-autonomous mode. In the semi-autonomous mode, systems external to the projectile are used to derive the projectile trajectory. By using the projectile trajectory and a known target location, the semi-autonomous system can signal the projectile to ignite the impulse motor at a specific time to change the projectile's course to land the projectile on the desired target. In the fully-autonomous mode, the projectile is programmed with the desired target location and then launched. The projectile, using systems incorporated within the projectile, determines the projectile trajectory and ignites the impulse motor at the time and angle necessary to land the projectile on the desired target. In either the semi-autonomous or fully-autonomous mode the desired target location may be updated while the projectile is in-flight through a data link to the projectile. The systems may then use the updated target information to determine when to ignite the course correcting impulse motor. This makes the present invention highly effective at striking a moving target and further compensating for the normal trajectory deviations found within projectile flight.

DESCRIPTION OF THE DRAWINGS

For a fuller understanding of the nature and objects of the present invention, references should be had to the following detailed description taken in connections with the accompany drawings.

FIG. 1 shows a predetermined and invariant thrust magnitude from a ballistic projectile equipped with the radial impulse motor of the present invention which may be used to change the trajectory of the projectile by varying only the time (where on the ballistic trajectory the thrust is applied) and angle (also a function of time in the present invention) at which the impulse motor is ignited to allow the projectile to strike a desired target.

FIG. 2 shows that the impulse motor rolls with the projectile rotation.

FIG. 5 shows the present invention's data link feature being used to update the desired target location in the projectile so that the projectile (if in a fire and forget configuration) may determine when to ignite the radial impulse motor to allow the projectile to strike the desired target.

DETAILED DESCRIPTION OF THE INVENTION

I. Introduction

The present invention operates in a semi-autonomous or fully-autonomous (fire and forget) mode. Both modes use a radial impulse motor to apply a precisely timed thrust vector to the projectile to affect a change in the projectile trajectory. In the semi-autonomous mode, ground based systems may be used to provide the projectile with the proper impulse ignition timing and angle. In the fully-autonomous mode, the projectile may receive updated target information from an external system, but the systems, wholly on board the projectile, data processing subsystem determines the proper impulse ignition timing and angle.

II. Projectile Course Correction

The present invention has three methods for determining projectile trajectory. The three methods are a fire control system (FCS) radar, a global positioning system (GPS), and an inertial navigation system (INS). All three methods may use a data link to the projectile to update the target information while the projectile is in-flight to correct for target location error.

a. Overview

Figure 1:
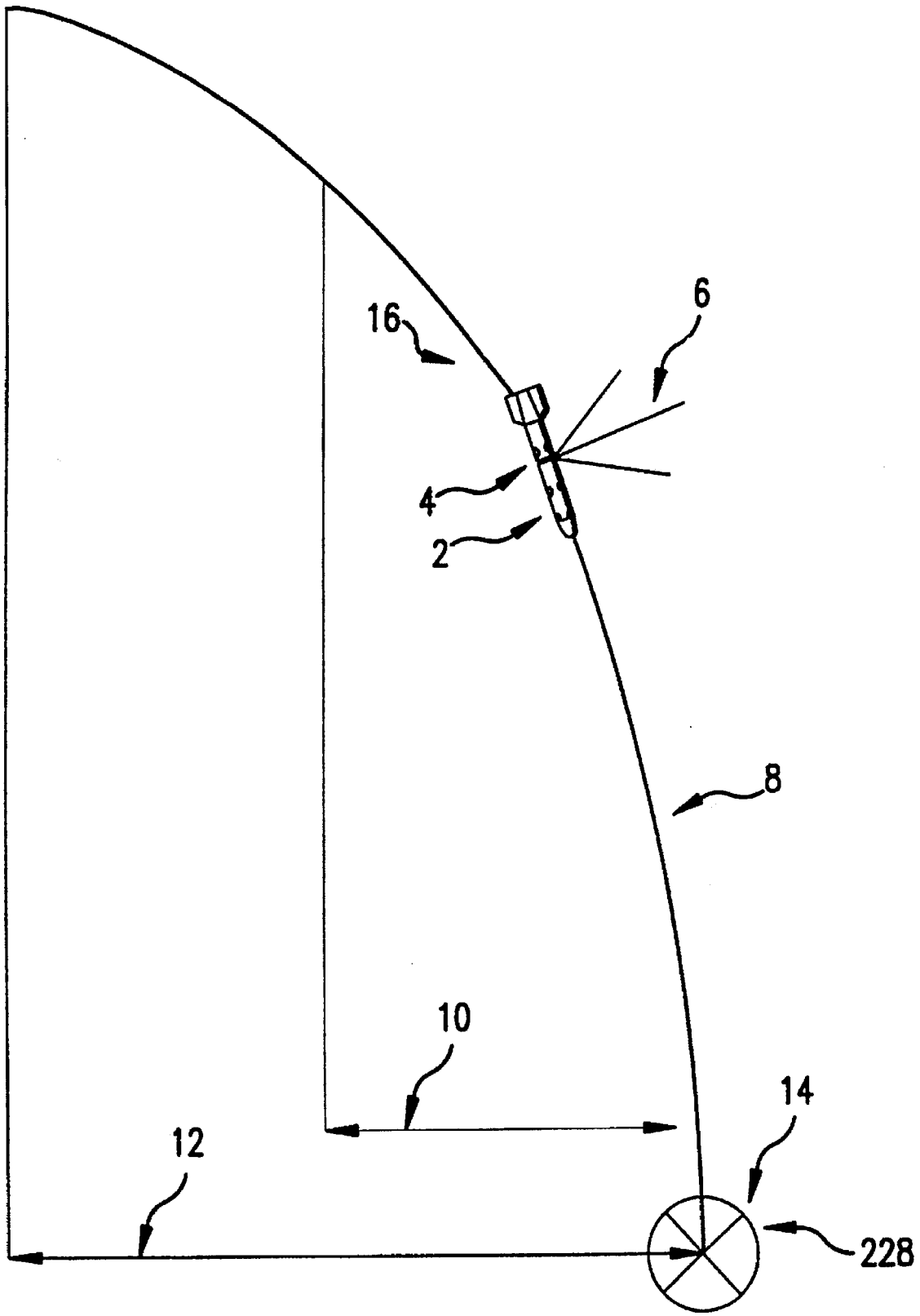
FIG. 1 shows a ballistic projectile of the present invention at the terminal stage of a ballistic trajectory.

FIG. 1 shows a projectile 2 with the radial impulse motor 4 of the present invention. The impulse motor 4 is incorporated into the projectile so as to act approximately on the projectile's center of mass after base bleed burn. This keeps the projectile from tumbling when the impulse motor 4 is actuated. The impulse motor 4 of the present invention may be used to impart an impulse of thrust at a fixed magnitude to the projectile 2. The projectile 2 may be spin stabilized by fins 16. The fins 16 may be retracted while the round is in the gun and spin stabilization may be used to provide the projectile 2 with a fixed roll rate with respect to its velocity.

The fixed roll rate may be used in the impulse motor 4 ignition calculations (described in detail below) to determine the precise ignition angle to impart the thrust vector at the proper time. It is understood that, soon after launch, less than three seconds, the projectile fins may be deployed. These fins, when deployed, may further reduce the projectile roll rate and because of a specific cant angle, fix the roll to remain reasonably constant during much of the time of flight. Furthermore, the fin size, form and number may be such so as to not overly induce unacceptable drag. The projectile 2 is shown in a trajectory 8 towards a desired target 14. As shown, the radial impulse motor 4 can create a thrust vector 6 in a plane normal to the projectile trajectory 8. By precisely timing the impulse motor 4 ignition and the angle of the thrust vector (a function of time because the projectile is rolling) a fixed amount of thrust may be used to change the projectile trajectory to land the projectile on a desired target. For example, given a projectile's trajectory 8 and its descent velocity as 250 meters per second, a 500 meter trajectory correction 12 may be performed by igniting the impulse motor 4 (creating a 50 meter per second transverse velocity vector) when the projectile 2 is at an altitude of 2500 meters. Likewise, given the factors above, a 250 meter trajectory correction 10 may be performed by igniting the impulse motor (also creating a 50 meter per second transverse velocity vector) when the projectile is at an altitude of 1250 meters. Thus, by changing the timing and angle of a single fixed magnitude thrust, the present invention may change the projectile trajectory to hit a desired target whenever the target resides within the zone of correction. It is understood that, certain projectiles whose warheads are multiple bomblets may have the aforesaid fins affixed with squibs and two possible positions. The first position is as described above to fix the roll rate of the projectile. The second position, after firing the squibs, may lock the fins in an increased cant angle causing the projectile to greatly increase its roll rate. This increased roll rate will permit the projectile to hurl the multiple bomblets contained in its warhead a greater distance thus increasing its radius of lethality. Note for such projectiles the proximity fuse would be activated as a function of time after launch first recanting the fin angle to position two then, bursting the round's outer casing to permit the bomblets to be radially launched forth.

b. The Radial Impulse Motor

Figure 2:
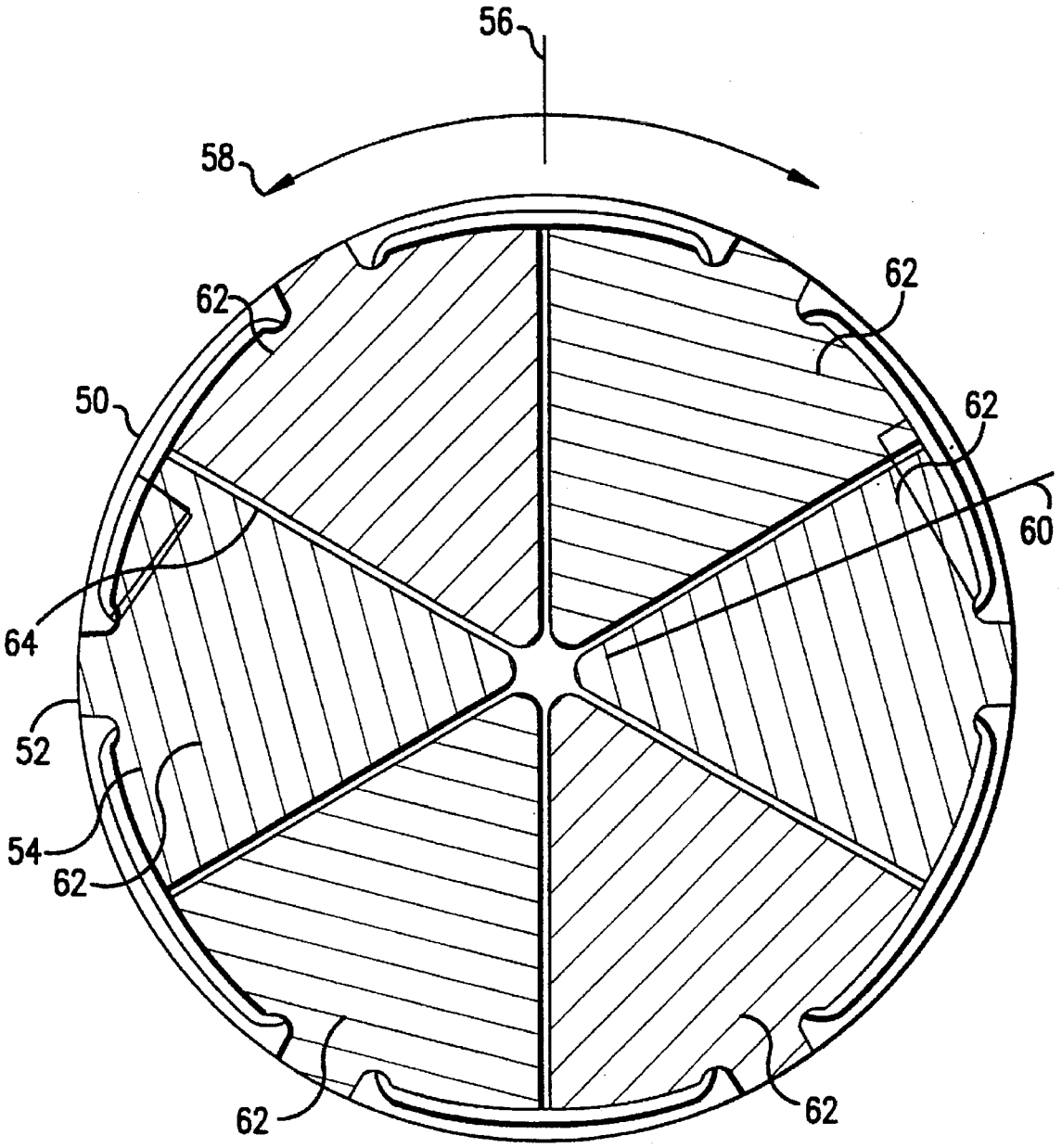
FIG. 2 shows the internal structure of the impulse motor of the present invention. The impulse motor has six combustion chambers filled with a solid or fine grained propellant and fuel with a fixed thrust nozzle(s). The actual number and shape of such combustion chambers are not critical to the design concept as shown in FIG. 2 except that the shape must be such to allow complete and rapid burning and the nozzles must be positioned such that the total thrust from any single combustion chamber and/or all of them averages at or near the gravimetric center of gravity of the projectile. For example, the impulse motors could also be shaped as an annulus divided into an appropriate number of chambers, each with one or more nozzles. The actual number of such combustion chambers is not critical to the design and is shown in FIG. 2 as an example of a realistic and available size. The thrust nozzle(s) may be oriented to create a thrust that is normal to the projectile trajectory.

FIG. 2 shows a cross sectional view of the radial impulse motor 4 that may be used in the present invention. The radial impulse motor 4 may comprise six combustion chambers or more or less 62 incorporated into the outer dimension 50 of the projectile 2. Each combustion chamber has a fixed thrust nozzle 52 and a chamber formed from the barriers 64 separating each chamber. The combustion chambers 62 may be filled with a very fine grain rapid burn solid fuel propellant or other appropriate propellant 54 to produce in total approximately 50/6 meters per second transverse velocity. A suitable propellant may be 940 grams of fine grain ammonium perclorate together with a suitable fuel such as butylane.

T = Burn Time for all (6) motors
$t_1$ = Burn time per motor
Ec = Energy capacity of fuel ≅ 2400 NS/kg
W = Weight of round ≅ 45 kg
$V_1$ = Desired lateral velocity from impulse motors (total)
$V_2$ = Round descent velocity
$N_1$ = Number of motors (combustion chambers)
$W(V_1)$ = Newton seconds = 45(50) = 2250 NS -continued W(V1) = Total Impulse Required = TIR $$\frac{TIR}{Ec} = \text{Grams of fuel required}$$

$$\frac{2250}{2400} = 940 \text{ grams}$$

The impulse motors 62 may be individually ignited by an ignition control system (discussed in detail below).

The combustion chambers 62 may be use in cooperation with one another to form a total thrust vector of approximately 50 meters per second. For example: Projectile 2 may have a rotational frequency 58 of approximately four hertz provided by stabilizer fins 16. If each combustion chambers fuel has a burn time of approximately twenty-five milliseconds, the change in angular position of a thrust nozzle 52 over the burn time is approximately seventeen degrees. Therefore, the fuel should start to burn approximately 8.5 degrees before and stop burning 8.5 degrees after the desired thrust angle. To illustrate, FIG. 2 shows an example thrust angle 60 at 70 degrees from the top center position 56 of the projectile. Given that the projectile 2 has a rotational frequency 58 of four hertz, and combustion chambers 62 may ignite at approximately 61.5 degrees (8.5 degrees before 70 degrees) and burn through to approximately 78.5 degrees (8.5 degrees after 70 degrees) to provide a composite thrust vector at 70 degrees. If each combustion chamber 62 is ignited at 61.5 degrees and each combustion chamber produces 50/6 meter per second of thrust then a total effective thrust of 50 meters per second at the desired 70 degree angle 60 will be achieved.

c. Projectile Electronics and Systems

Figure 3:
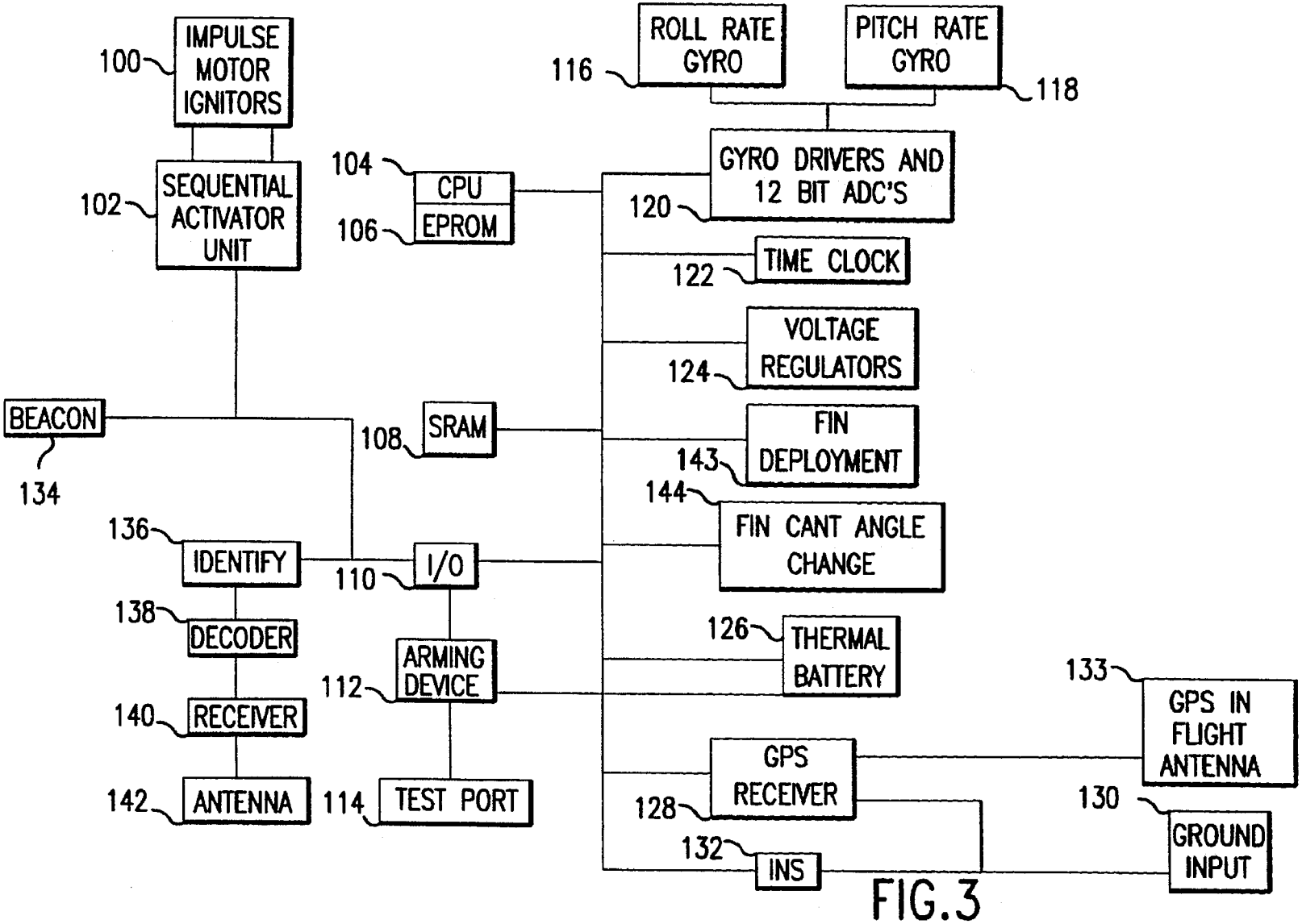
FIG. 3 shows the internal electronics and components of the course correctable projectile of the present invention. The internal electronics shown in FIG. 3 reflect the multiple configurations available with the present invention. The three configurations of gyroscopic/ground control, global positioning system/internal control and inertial navigation system/internal control are shown connected a microprocessor, a SRAM memory, an input/output interface, a thermal battery, voltage regulators, a ground input interface, antennas, receivers, decoders, identifier circuits, a beacon transponder, sequential activators, and the motor ignitors.

FIG. 3 shows the systems incorporated into the projectile 2 to control the ignition of the radial impulse motor 4. The components incorporated into the projectile may comprise an impulse motor ignitor 100, a sequential activator unit 102, a microprocessor 104, an EPROM 106, SRAM memory 108, an input/output interface 110, arming device and digital clock 112, a test port interface 114, a roll rate gyro 116, a pitch rate gyro 118, analog to digital converter for the gyros 120, a digital time clock 122, voltage regulators 124, a thermal battery 126, a GPS receiver 128, a GPS ground input 130, an inertial navigation system 132, a GPS in-flight antenna 133, a beacon transmitter 134, identifier circuits 136, a decoder 138, a receiver 140, an antenna 142, fin deployment driver 143, and fin cant angle change driver 144. The roll rate gyro 116, the pitch rate gyro 118, GPS receiver 128 and GPS antenna 133, and the inertial navigation system 132 may be configured so that certain subsystem components may be eliminated. For example, one or both axes of the gyros 116 and 118 and associated analog to digital converter 120, may be eliminated when the projectile is configured with the GPS receiver 128 and GPS antenna 130. Likewise, the inertial navigation system 132 may eliminate the need for the GPS receiver 128, the GPS antenna 133 and/or one or both of the gyros 116 and 118. As the different projectile modes are described below, it will be appreciated by those skilled in the art that various projectile configurations may be used in the present invention.

The arming device 112 of the present invention may be used to automatically arm the radial impulse motor 4 after detecting a launch or in response to a centrifugal switch. It is understood that the explosive payload of the projectile 2 may be conventionally safe/armed and fused.

The thermal battery 126 used in the present invention is well known to the art and may be used to power the projectile electronics. It is understood that the thermal battery 126 may be actuated in the moments before launch to allow the system to receive power to allow the initial target programming for the projectile 2. It is understood that voltage from the thermal battery may be regulated by voltage regulator 124.

It is understood to those in the integrate control system arts that an erasable programmable memory (EPROM) 106 may be used to store a control program. The EPROM 106 may contain the program necessary for microprocessor 104 to execute the control functioning for the present invention.

Static random access memory (SRAM) 108 may be used by the microprocessor 104 to store variable and/or execute segments of the control program.

Input/output device 110 may be an interrupt driven buffer interface, to interface peripheral devices to the microprocessor 104.

It is understood that beacon 134 may be used in conjunction with antenna 142, receiver 140, decoder 138, and identifier circuits 136 to provide an active response to a fire control radar signal. A beacon acting in response to ground radar is well known in the art and can be used to identify one round from another and to determine the round's position in object space.

1. Determining Projectile Roll Rate, Roll Position, and Pitch

The present invention may determine, depending of the projectile electronics configuration, the projectile roll rate, roll position, and pitch in several different ways.

A. Gyro Mode

The present invention may use roll rate gyro 116, pitch rate gyro 118, analog to digital converter 120, and microprocessor 104 to determine the projectile roll rate, roll position and pitch. It is understood that the gyros 116 and 118 are a solid state design that can survive the projectile launch acceleration. The thermal battery 126 may provide power for the gyros 116 and 118 to maintain the gyros at operational level and throughout the projectile flight. The gyros 116 and 118 provide an analog electronic signal to a dual channel 12 bit analog to digital converter 120. The analog to digital converter 120 may output a digital signal that represents the analog signal from the gyros 116 and 118 to the microprocessor 104. It is understood that the microprocessor 104 may use well known techniques to translate the digital representation of the signal from the gyros to determine the projectile roll rate, roll position, and pitch. Roll position may be determined from (1) knowing vertical and (2) counting the revolutions.

The pitch rate gyro when used in conjunction with a Kalman filter procedure, can interpolate bending due to gravity and by integrating many times, a reasonably accurate vertical reference may be obtained. Another method of obtaining a vertical reference is measuring the rise and decay of a GPS cluster signal and after several integrations, a reasonable vertical reference may be realized. Another method may be to use an annulus ring of polished hardened tetrafluoroethylene fluorocarbon polymer (e.g., TEFLON®) filled with a heavy substance that will remain in the liquid state before and during launch and flight such that the coefficient of cohesion is greater than the coefficient of adhesion wherein gravity will, along with the liquid's own cohesive properties, enable it to detect vertical via contact with two electrical points.

Roll, once a vertical reference is achieved, may be calculated via the roll rate gyro or can be a simple by-product of methods 2 and 3. Exact position of roll from vertical is via integrating time for 360° and thence any angle can be reasonably determined.

B. GPS Mode

Figure 4A:
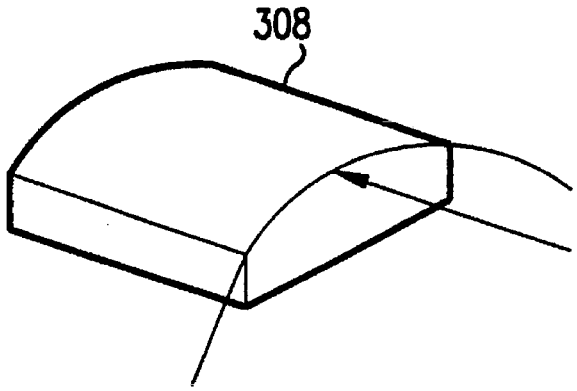
FIG. 4A shows a global positioning system antenna radome with a heatshield radome exterior conformal and flush mounted to a projectile.
Figure 4B:
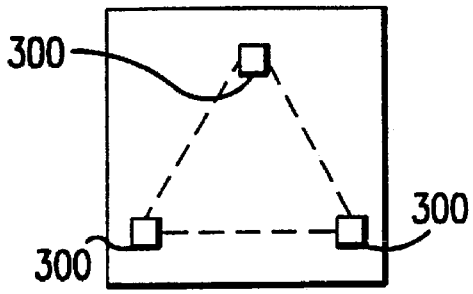
FIG. 4B shows a global positioning system antenna array that may be used in the FIG. 4A radome.
Figure 4C:
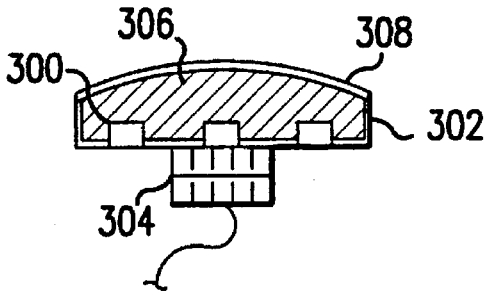
FIG. 4C shows the internal configuration of the global positioning system antenna array and radome configuration shown in FIGS. 4A and 4B has internal potting and a pin connector to attach to the projectile.

FIG. 4 shows a GPS antenna incorporated into a 155 mm round. The GPS antenna 133 may have a GPS receiver antenna array 300, a GPS antenna case 302, a pin connector 304, an internal permeable high "g" potting 306, and a heatshield/radome 308. The GPS antenna 133 may receive signals from a cluster of GPS satellites and pass the signal to the GPS receiver 128. Using techniques well known to the GPS satellite art, the GPS receiver may determine the GPS location of the projectile. The projectile of the present invention may use one or more GPS antenna 130 to maintain a GPS receiver lock while the projectile is spinning.

The present invention may also use the signal from a GPS antenna 133 to determine the roll rate of the projectile 2. A GPS satellite cluster will provide a relatively fixed continuous signal during a projectile's relatively short flight time. Therefore, the laterally mounted GPS antenna 133 of the present invention will produce a signal from the GPS satellite that reflects the roll rate of the projectile 2. In other words, a GPS satellite signal from a GPS antenna 133 may "wobble" in amplitude at the same frequency as the projectile roll rate. Therefore, the GPS receiver 128 and/or microprocessor 104 may use the GPS signal wobble to determine the projectile roll rate. Thus, in the GPS configuration the roll rate gyro 116, and pitch rate gyro 118 and associated analog to digital circuits 120 may be eliminated.

C. INS Mode

As well known to the navigational arts an inertial navigation system (INS) may use a combination of precision gyro(s) and accelerometers to determine the motion of the INS through space. The present invention may use a fiber optic inertial navigation system 132 to determine the projectile trajectory. The INS 132 in the INS configuration of the present invention may still require the roll rate gyro 116, pitch gyro 118, gyro analog to digital converter circuits 120 to determine vertical reference and angular body position. The INS 132 configuration may still use the ground input interface 130 to receive the firing coordinates 204 and initial target coordinates 14 with respect to TLE. The thermal battery 126 may be activated prior to projectile launch to allow the INS 132 to become operational. No FCS will be required with the INS 132 system.

III. Operational Modes and Configurations

Figure 5:
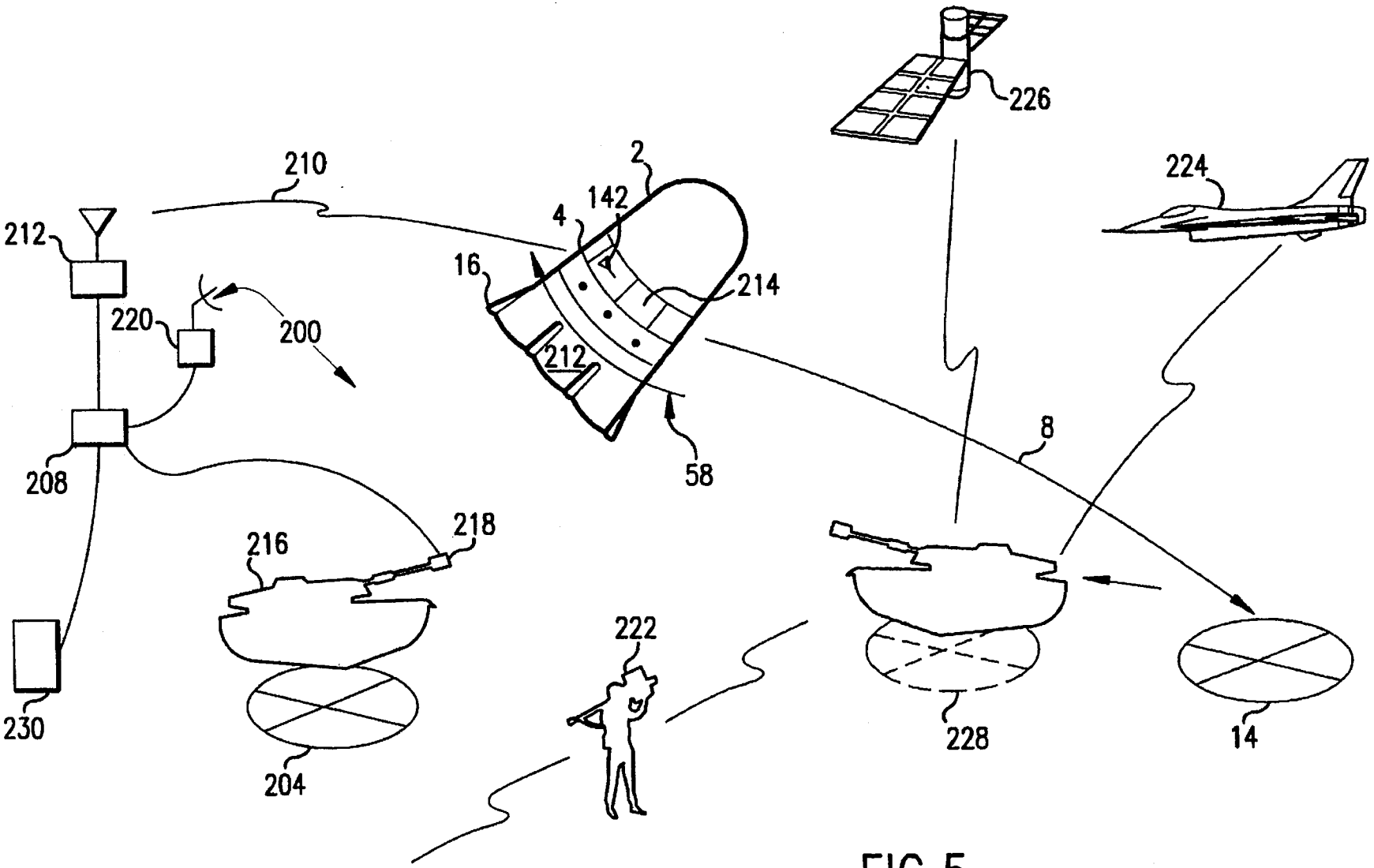
FIG. 5 shows the present invention in use against a moving target and in conjunction with other tactical battle field information gathering systems.

FIG. 5 shows the present invention and the system's associated fire control system. The present invention operates by determining the projectile trajectory by a variety of means, determining the course correction vector, and igniting the radial impulse motor 4 to impart the course correction to the projectile to allow the projectile to strike a desired target. The three modes of the present invention share the common feature of using a data link to the projectile to allow the desired target location to be updated while the projectile is in flight. In the ground controlled (semi-autonomous) mode, the change in the desired target location may be reflected in a ignition timing signal sent to the projectile over the data link. In the fire-and-forget (fully-autonomous) modes the change in the desired target location may be sent to the projectile over the data link. The projectile then makes the necessary ignition timing adjustments using the projectile's internal electronics to ignite the radial impulse motor 4 to cause the projectile to strike the desired target. The present invention will be best understood by first describing the ground controlled semi-autonomous mode and then describing the fully autonomous modes.

a. Fire Control System (Semi-Autonomous Mode)

The fire control system (FCS) (semi-autonomous mode) uses a means for determining the projectile trajectory 8, a known gun location 204, a desired target location 14, a ground based computer 208, a data link from the ground to the projectile 210, and a means 214 for determining the projectile roll rate, roll position and pitch, to determine when to ignite the radial course correction impulse motor 4. The FCS and/or the projectile in flight may also have a means for receiving an updated target location from a plurality of means. These means include a data link from a forward observer 222, a data link from a suitably equipped spotter aircraft 224, a data link from a reconnaissance satellite 226, and/or from a battle field command and control center 230. The updated target information 228 may be used by the FCS computer 208 in the projectile course correction calculations. Suitable equipment for a forward observer 222 and spotter aircraft 224 may include a data link transceiver, a GPS receiver and a laser range finder.

1. Determining Projectile Trajectory

A. FCS Radar

It is well known in the art a ground based radar may be used to track a projectile trajectory. This may be accomplished in a conventional radar mode, i.e., where the projectile passively reflects the radar signal back to the radar receiver, or in a transponder mode, i.e., where the projectile actively transmits a transponder signal in response to the radar signal and/or to a passive radar antenna. Doppler radar techniques may also be used to determine the projectile velocity. The radar information is used to determine the actual projectile trajectory, as well as its X, Y, Z position in object space.

B. Muzzle Velocity Detector

A muzzle velocity detector 218 may be used to detect internal ballistic information from a projectile immediately upon projectile launch. This information may be used by the FCS to pre-position the FCS radar 220 to bring the radar into a quick radar lock and track condition. The coupling of these two techniques may reduce the time needed for active radar transmission 200. Reducing the time necessary for active radar transmission 200 is critical in a modern battle field bristling with anti-radar missiles and counter radar artillery systems.

2. Calculating the Course Correction Vector

The FCS computer 208, after determining the projectile trajectory from the muzzle velocity detector 218 and/or the active radar transmission 200 by FCS radar unit 220 and after receiving the last possible target location update 228, calculates the precise time and angle for impulse motor 4 ignition. This information is conveyed by a transmission 210 over the FCS-projectile data link 212 to the projectile data link antenna 142. It is understood that the data link between the FCS and the projectile may be a high speed burst or chirp transmission and/or other transmission formats that have a suitable high data rate and low probability of detection or influence from electronic counter measures (ECM).

3. Impulse Motor Ignition

The information transmission 210 over the FCS data link 212 is received by the data link antenna 142. The antenna 142 passes the signal to the data link receiver 140. The data link receiver demodulates the data link signal into a digital bit stream and passes this bit stream to a digital decoder 138. The digital decoder 138 decodes the digital bit stream from a suitable digital code format well known to those in the arts. A suitable code format may include a forward error correction format and/or Reed-Solomon encoding. The decoded data leaves the decoder 138 and goes to the identifier circuits 136. The identifier circuits 136 are used to validate that the data link signal was intended for this particular projectile. The identifier 136 may also be used to prevent a deceptive data link signal from erroneously directing the projectile. If the data link signal contains the correct identity code, then identifier 136 will allow the bit stream to pass through to the input/output (I/O) interface 110. The I/O interface 110 provides an interrupt signal to the microprocessor 104. The microprocessor 104 processes the interrupt from the I/O interface 110 by receiving the data from the I/O interface 110 data buffer and moving the data to the SRAM 108 storage. The microprocessor 104 program compares the received impulse motor 4 ignition time and angle to the internal time clock 122. The time clock 122 is maintained by a crystal oscillator and/or with GPS time from the GPS receiver 128. When the microprocessor 104 determines that the time and the angle are correct the microprocessor 104 sends an ignition command to the I/O interface device 110 directed to the sequential activator unit 102. The sequential activator unit 102 immediately generates sequential signals to the impulse motor ignitors 100. The impulse motor ignitors 100 then ignite the corresponding combustion chamber 62.

b. GPS Control System (Fully-Autonomous Mode)

In the GPS mode the projectile may operate in a true fire and forget mode. That is, once the projectile is launched, the firing platform (e.g., a self-propelled cannon) may immediately move to avoid counter-artillery fire. The GPS mode may function as follows:

The thermal battery 126 may be activated to provide power to the projectile electronics; the ground input 130 may be used to provide the microprocessor 104 with the launch coordinates 204 and desired target coordinates 14. Likewise, the ground input may be used to provide the GPS receiver 128 with the projectile launch coordinates and information necessary for the GPS receiver 128 to establish a receiver lock on the GPS satellites in use by a ground based GPS receiver (not shown). It is understood by those in the art that the ground input 130 may use a magneto-acoustic coupling to provide an interface between the projectile and the ground systems while the projectile is in the gun breech. After the projectile 2 is launched, the GPS receiver 128 may establish a receiver lock on the GPS satellites cluster with the GPS in-flight antenna array 133. The microprocessor 104 may receive the projectile location from the GPS receiver 128 to determine the projectile trajectory 8. The microprocessor 104 may receive projectile pitch information from the pitch gyro 118 via the gyro analog to digital converter 120 or the GPS system. As noted above, the microprocessor 104 may determine the roll rate of the projectile from the roll gyro 116 via analog to digital converter 120 or determine the roll rate from the GPS signal wobble from a GPS antenna 133. The microprocessor 104 may use the trajectory 8, roll, pitch and desired target location to determine the precise time and angle to fire the impulse motor 4 to land the projectile at the desired target 14. The FCS computer 208 may, however, update the desired target location 228 in the projectile with a transmission 210 over the FCS-projectile data link 212 to the projectile data link antenna 142.

Either the ground CPU or the onboard CPU (in the fully autonomous mode) calculates both the angle and the time to achieve the 6° of freedom thrust vector; e.g., 0° or 180° will decrease or increase range, 90° and 270° will adjust the impact to the left or right, and all angles in between will achieve a combination of any of the above, with the magnitude of the correction being a function of the time the impulse motors are fired prior to impact, i.e., later=less correction and less affect from external ballistics; earlier=more correction but more problems from external ballistics.

c. INS Control System (Fully-Autonomous Mode)

The INS mode may require the INS to track of the round's position in object space to hit a known target preprogrammed into the system.

It is well-known to those in the navigation arts that an INS may track its location in object space when the INS is initially programmed with its location. The present invention uses a standard INS fiber optic laser gyroscope (ruggedized to withstand the launch acceleration) in place of the FCS tracking system. This embodiment may function in a fire and forget mode. It is important to note that because the fully autonomous modes may not use a ground based radar or transponder system, the projectile may be constructed of stealth (or radar absorbent) materials to prevent tracking the projectile by counter-artillery batteries.

d. Warhead Deployment

Certain projectiles whose warheads are multiple bomblets may have two modes of fins deployment. It is understood that fin deployment driver 143 may deploy the fins in the first described spin stabilization mode. A second deployment of the fins may increase the cant angle of the fins causing the projectile to greatly increase its roll rate. The system may use the fin cant angle change driver 144 to change the cant angle of the fins. This increased roll rate will permit the projectile to hurl the multiple bomblets contained in its warhead a greater distance thus increasing the warhead's radius of lethality. Note that for such projectiles a proximity fuse may be activated as a function of time after launch to change the fin angle from position one to position two, then bursting the round's outer casing to permit the bomblets to be radially launched forth.

The present disclosure includes that contained in the appended claims as well as that of the foregoing description. Although this invention has been particularity described it is understood that the present disclosure of the present invention is only made by way of example and that numerous changes in the detail of construction and the combination and arrangement of parts may be resorted to without departing from the spirit and scope of the invention.

Accordingly, I claim:

1. A system for controlling the placement of an airborne vehicle, comprising:

an airborne vehicle having a ballistic trajectory and a roll rate, roll position and pitch while in said trajectory;

a radial impulse motor, incorporated into said airborne vehicle, for imparting a radial thrust on said airborne vehicle while said airborne vehicle is in said trajectory;

a receiver, incorporated into said airborne vehicle, for receiving targeting information;

means for determining said trajectory;

means for determining said airborne vehicle roll rate, roll position and pitch;

means for determining a vertical reference for said airborne vehicle; and a computer, linked to said radial impulse motor, said receiver, said means for determining said trajectory, said means for determining said airborne vehicle roll rate, roll position and pitch, and said means for determining a vertical reference, for determining a time during said trajectory of said airborne vehicle and an angle of corrective vector to ignite said radial impulse motor to affect the trajectory of said airborne vehicle to direct said airborne vehicle towards a desired target.

2. The system of claim 1, wherein said airborne vehicle includes at least one fin having more than one mode of deployment.

3. The system of claim 2, further comprising means for controlling said modes of deployment of said at least one fin.

4. The system of claim 1, wherein said airborne vehicle is a projectile adapted to be launched from a gun.

5. The system of claim 1, wherein said airborne vehicle is a rocket.

6. The system of claim 1, wherein said airborne vehicle is a bomb.

7. The system of claim 1, wherein said airborne vehicle includes a warhead having multiple bomblets.

8. The system of claim 1, wherein said means for determining said trajectory comprises a fiber optic laser gyroscopic inertial navigation system incorporated into said airborne vehicle.

9. The system of claim 1, wherein said means for determining said trajectory comprises a ground based fire control radar system.

10. The system of claim 9, wherein said means for determining said trajectory further comprises a muzzle velocity detector.

11. The system of claim 1, wherein said means for determining said trajectory comprises:

a satellite based global positioning system (GPS) receiver and a GPS antenna array incorporated into said airborne vehicle;

a GPS position signal; and a computer for processing said GPS position signal to determine said trajectory of said airborne vehicle.

12. The system of claim 1, wherein said means for determining said roll rate, roll position and pitch comprises a satellite based global positioning system (GPS) signal and a GPS antenna array, said GPS antenna array being incorporated onto said airborne vehicle to produce a signal that corresponds to said roll rate, roll position and pitch of said airborne vehicle.

13. The system of claim 1, wherein said targeting information comprises a launch location of said airborne vehicle and a target location.

14. The system of claim 1, wherein said airborne vehicle further comprises a plurality of radial impulse motors adapted to deliver an impulse at a center of mass of said airborne vehicle, said impulse motors firing through a predetermined angle, thereby applying a composite thrust vector at a predetermined composite thrust force.

15. The system of claim 1, wherein said means for determining a vertical reference comprises an annular ring of polished tetrafluoroethylene fluorocarbon polymer containing a heavy conductive substance.

16. The system of claim 1, wherein said means for determining said roll rate, roll position and pitch comprises a fiber optic laser gyroscope incorporated into said airborne vehicle.

17. A method of guiding an airborne vehicle towards a desired target, said airborne vehicle having a ballistic trajectory and a roll rate, roll position and pitch while in said trajectory, a center of mass, a receiver for receiving targeting information, a radial impulse motor for delivering an impulse to the airborne vehicle at said center of mass, a roll rate sensor, a pitch sensor, means for determining said trajectory, and a computer for performing targeting calculations, said method comprising the steps of:

receiving targeting information from an external source, said targeting information being loaded into the computer for use in the targeting calculations;

launching said airborne vehicle into said trajectory;

determining said trajectory;

determining said roll rate, roll position and pitch;

calculating a time and an angle at which to ignite the radial impulse motor to change the trajectory of said projectile to direct the projectile towards the desired target; and igniting said impulse motor at the time and angle calculated in said calculating step.

18. The method of claim 17, wherein said airborne vehicle further includes at least one fin having more than one mode of deployment and said method further comprises the step of:

controlling the mode of deployment of said at least one fin to vary the roll rate of said airborne vehicle.

19. The method of claim 17, wherein said step of determining the trajectory is performed utilizing a satellite-based global positioning system (GPS) and a GPS receiver incorporated into said airborne vehicle.

20. The method of claim 17, wherein said step of determining the trajectory is performed utilizing a fiber optic laser gyroscope-based inertial navigation system incorporated into the projectile.

21. The method of claim 17, wherein said step of receiving targeting information is performed utilizing a data link between a ground-based transmitter and a receiver incorporated into the airborne vehicle.

22. A method of guiding an airborne vehicle towards a desired target, said airborne vehicle having a ballistic trajectory and a roll rate, roll position and pitch while in said trajectory, a center of mass, a receiver for receiving targeting information, a radial impulse motor for delivering an impulse to the airborne vehicle at said center of mass, a roll rate sensor, a pitch sensor, and a computer for performing targeting calculations, said method comprising the steps of:

receiving targeting information from an external source, said targeting information being loaded into the computer for use in the targeting calculations;

launching said airborne vehicle into said trajectory;

determining said trajectory;

determining said roll rate, roll position and pitch;

calculating a time and an angle at which to ignite the radial impulse motor to change the trajectory of said projectile to direct the projectile towards the desired target; and igniting said impulse motor at the time and angle calculated in said calculating step.

23. The method of claim 22, wherein said step of determining the trajectory is performed utilizing a ground-based fire control radar.

* * * * *